US008714995B2

(12) United States Patent
Chang

(10) Patent No.: US 8,714,995 B2
(45) Date of Patent: May 6, 2014

(54) SAFETY SOCKET

(71) Applicant: Chi-Tsai Chang, Taichung (TW)

(72) Inventor: Chi-Tsai Chang, Taichung (TW)

( * ) Notice: Subject to any disclaimer, the term of this patent is extended or adjusted under 35 U.S.C. 154(b) by 0 days.

(21) Appl. No.: 13/711,146

(22) Filed: Dec. 11, 2012

(65) Prior Publication Data

US 2013/0157495 A1 Jun. 20, 2013

(30) Foreign Application Priority Data

Dec. 14, 2011 (TW) ..... 100223639 U

(51) Int. Cl.
*H01R 4/50* (2006.01)

(52) U.S. Cl.
USPC ..... 439/345

(58) Field of Classification Search
USPC ..... 439/345, 404, 145, 263, 381, 650–651, 439/134, 137, 139, 342, 346–347, 368–371, 439/518
See application file for complete search history.

(56) References Cited

U.S. PATENT DOCUMENTS

| | | | | |
|---|---|---|---|---|
| 2,528,014 | A * | 10/1950 | Moses, Jr. et al. | 439/137 |
| 2,654,073 | A * | 9/1953 | Katz | 439/134 |
| 5,839,909 | A * | 11/1998 | Calderara et al. | 439/137 |
| 8,382,497 | B2 * | 2/2013 | Huang | 439/137 |

* cited by examiner

*Primary Examiner* — Edwin A. Leon

(57) ABSTRACT

A safety socket of the present invention is adapted for receiving a plug and further alternatively locking the plug. Specifically, an operation portion adapted for a user to switch moves substantially parallely to a front plate of the safety socket so that the operation portion is adapted for being switched between locking state and unlocking state.

12 Claims, 8 Drawing Sheets

SAFETY SOCKET

BACKGROUND OF THE INVENTION

1. Field of the Invention

The present invention relates to a socket, more specifically to a safety socket which is able to prevent plugs from detaching.

2. Description of the Prior Art

A conventional safety socket disclosed in GB 2383202 includes an inclined plate, and a hole formed on the plate positions a plug to prevent the plug from detaching. In addition, TW M285106 and WO 2010/029511 also disclose related skills for improving security of the socket.

Furthermore, U.S. 2008/0076291 and TW 201110479 introduce other positioning elements to position the plug on the socket for security.

However, although the previous patents do improve security, the sockets are not convenient to use. The sockets disclosed in GB 2383202, TW M285106, and WO 2010/029511 have to be operated by two hands to press buttons or other elements and to pull the plug. Moreover, the sockets disclosed in U.S. 2008/0076291 and TW 201110479 is more inconvenient that positioning elements have to be released before detaching the plug.

SUMMARY OF THE INVENTION

The main object of the present invention is to provide a safety socket which is easy to operate.

To achieve the above and other objects, a safety socket of the present invention includes a shell, a suppress mechanism, and a limitation mechanism.

The shell has a front plate forming a set of plug holes. The set of plug holes includes at least two insertion holes adapted for a corresponding plug to insert therein. The plug includes at least two metal pins which are able to be inserted into the insertion holes.

The suppress mechanism is disposed inside the front plate of the shell and corresponds to one of the insertion holes. The suppress mechanism is able to be switched between a suppress position and a release position. When the suppress mechanism is located at the suppress position, the suppress mechanism buckles to the metal pin inserted into the insertion hole which corresponds to the suppress mechanism. On the contrary, when the suppress mechanism is located at the release position, the metal pin is able to enter or leave the insertion hole which corresponds to the suppress mechanism.

The limitation mechanism is disposed to the shell and includes an operation portion and a limiting portion. The operation portion and the limiting portion are in a linking-up correlation. The limiting portion extends near the suppress mechanism. The operation portion is located partially outside the front plate and is able to be switched between a first position and a second position. When the operation portion is located at the second position, the limiting portion is separated from the suppress mechanism so that the suppress mechanism is able to be switched between the suppress position and the release position.

Thereby, the safety socket of the present invention can be operated by a user with one hand.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
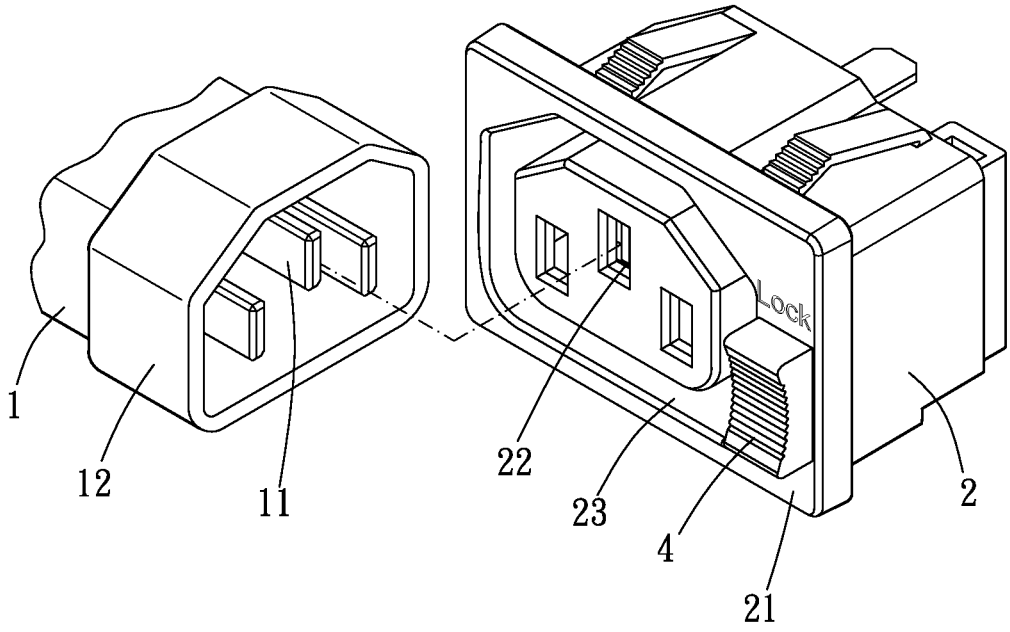
FIG. 1 is a stereogram of the present invention.
Figure 2:
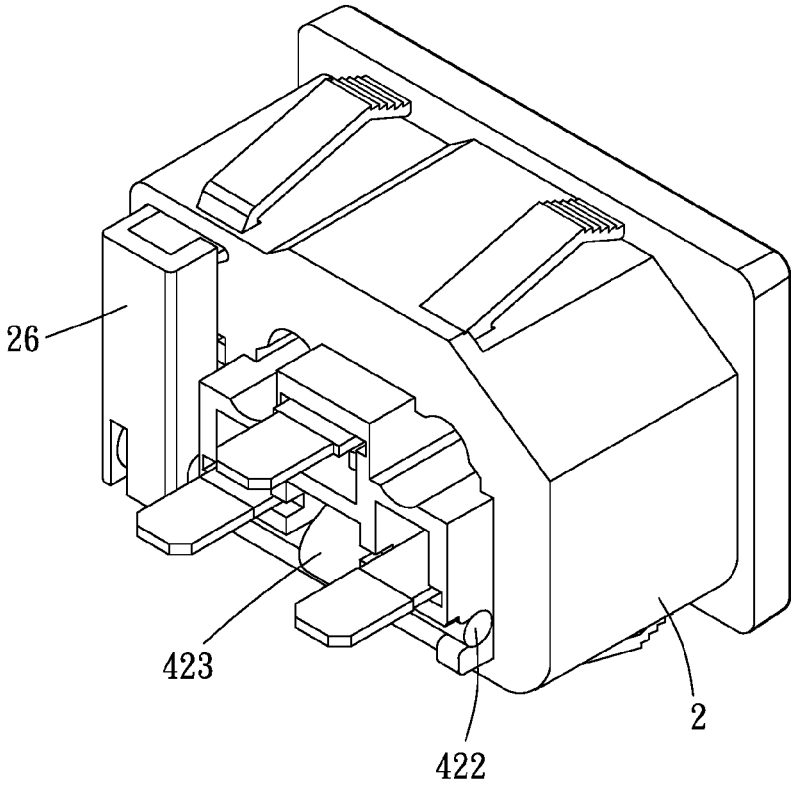
FIG. 2 is a stereogram at another angle of the present invention.
Figure 3:
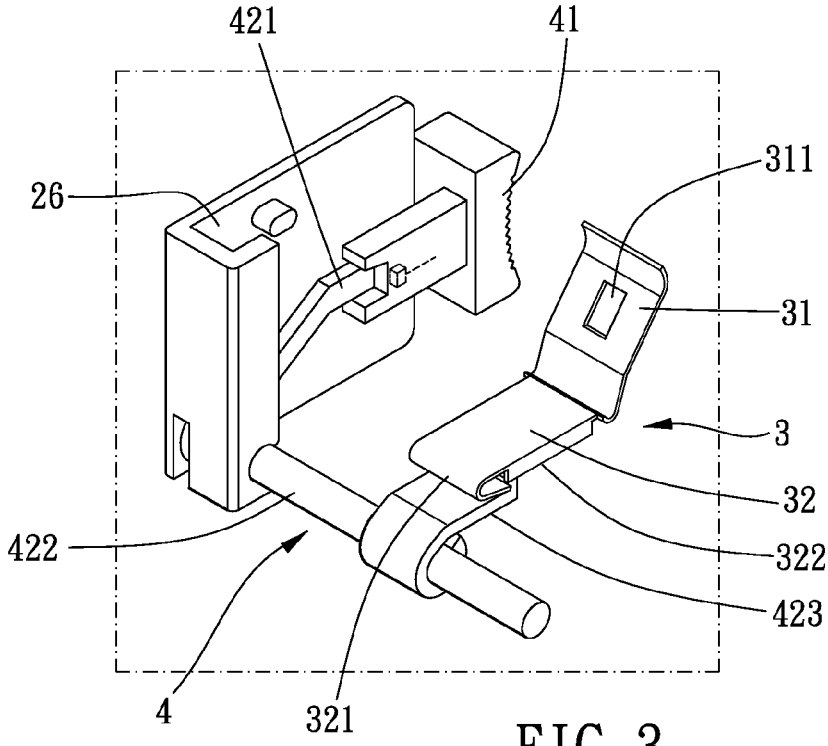
FIG. 3 is a partial stereogram of the present invention.
Figure 4:
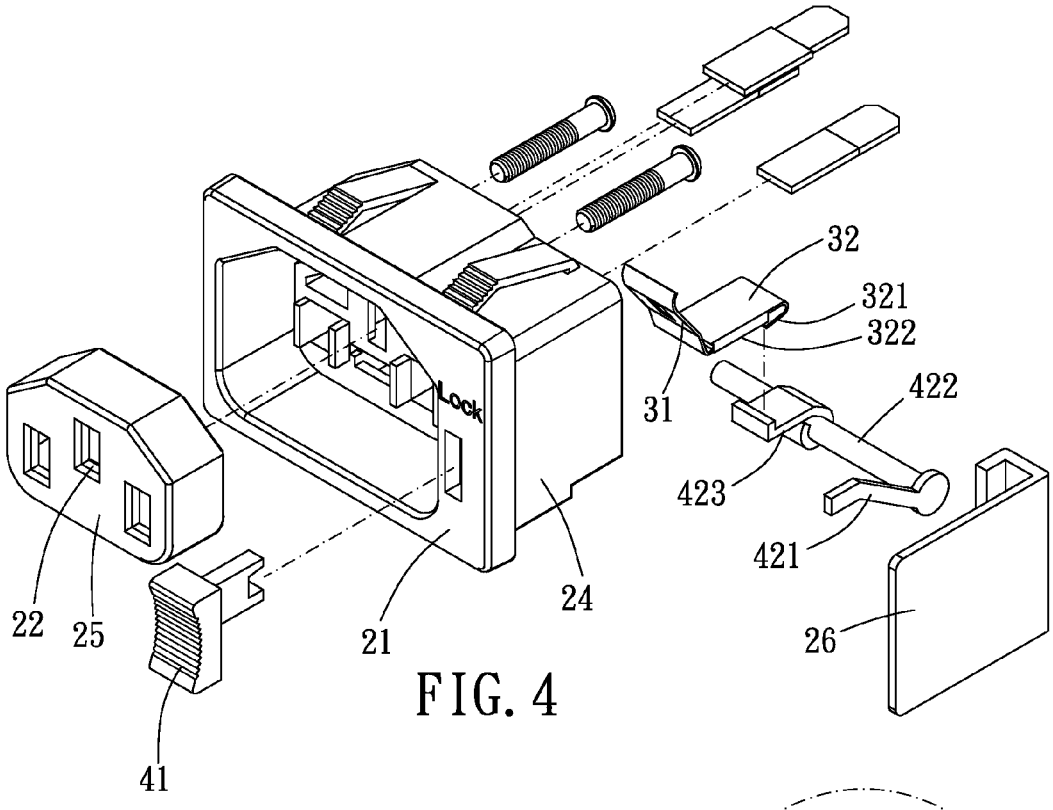
FIG. 4 is a breakdown drawing of the present invention.
Figure 4A:
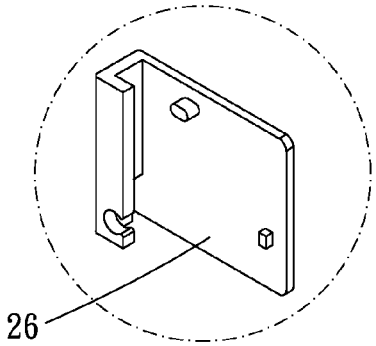
FIG. 4A is a breakdown drawing of a fixing plate at another angle of the present invention.

Please refer to FIG. 1, the safety socket of the present invention is adapted for a corresponding plug 1 to insert therein. Specifically, the plug 1 has three metal pins 11 and a cover 12 surrounding the metal pins 11. However, the present invention can be utilized with other common plugs. Please refer to FIG. 1 to FIG. 5, the safety socket of the present invention includes a shell 2, a suppress mechanism 3, and a limitation mechanism 4.

The shell 2 has a front plate 21 forming a set of plug holes. The set of plug holes is adapted for a corresponding plug 1 to insert therein and includes three insertion holes 22 and a groove 23 which surrounds the insertion holes 22. The metal pins 11 are inserted into the insertion holes 22, and the cover 12 is inserted into the groove 23. In the present invention, the shell 2 comprises an external shell 24, an internal shell 24, and a fixing plate 26. The insertion holes 22 are formed on the internal shell 25, and the groove 23 is formed between the internal shell 25 and the external shell 24.

Figure 5:
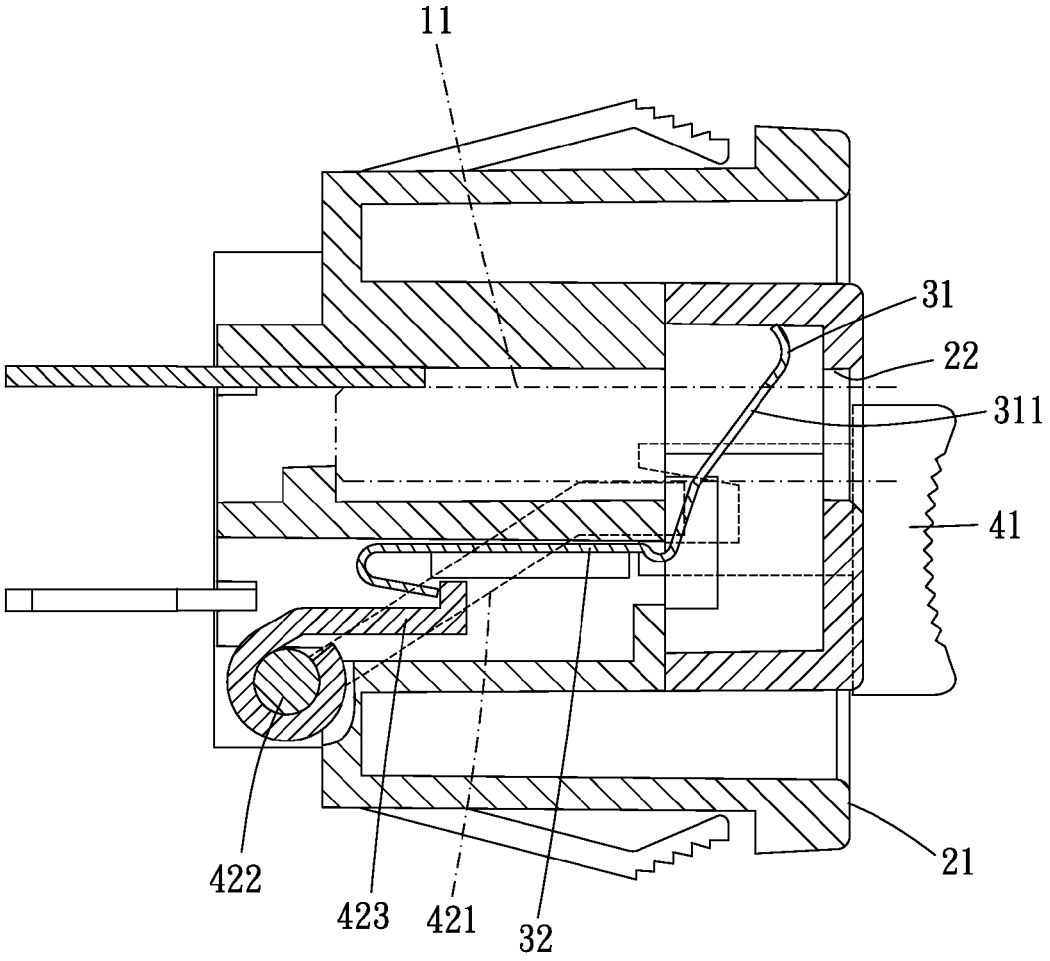
FIG. 5 is a profile of the present invention.

The suppress mechanism 3 is disposed inside the front plate 21 of the shell and corresponds to one of the insertion holes 22. Preferably, the suppress mechanism 3 is a bent metal plate and includes a suppress plate 31 and a buckle plate 32. An end of the suppress plate 31 is fixedly disposed to the shell 2, and an opposite end of the suppress plate 31 is connected with the buckle plate 32. The suppress plate 31 forms a through hole 311. The buckle plate 32 extends inward away from the front plate 21 and forms a hook portion 321. More preferably, the buckle plate 32 forms enhance ribs 322 at two opposite sides wherein the enhance ribs 322 are bent perpendicularly to improve structure intensity of the buckle plate 32. The suppress mechanism 3 is able to be switched between a suppress position and a release position. As shown in FIG. 5, when the suppress mechanism 3 is located at the suppress position, the suppress plate 31 is inclined with respect to the front plate 21. When the buckle plate 32 is moved toward the front plate 21 so as to change the angle between the suppress plate 31 and the front plate 21 to switch the suppress mechanism to the release position. In addition, the suppress mechanism 3 is resilient so that the suppress mechanism tends to be located at the suppress position.

The limitation mechanism 4 is disposed to the shell 2 and includes an operation portion 41 and a limiting portion. The operation portion 41 is preferably a toggle switch. The operation portion 41 is slidably disposed on the shell 2 and is partially located outside the front plate 21 for being toggling. Thus, the operation portion 41 is able to be switched between a first position and a second position along a straight line. Specifically, the operation portion 41 slides along a path parallel to the front plate 21. In addition, the operation portion 41 is connected to the limiting portion and is in a linking-up correlation with the limiting portion. The limiting portion includes a first connecting rod 421, an axle rod 422, and a second connecting rod 423 wherein the first connecting rod 421 and the second connecting rod 423 are disposed to the axle rod 422 respectively and are in a linking-up correlation with the axle rod 422. In the present invention, the axle rod 422 is a circular rod and is fixed to the connecting rods by tight-fitting, gluing, screwing, or fusion. For the linking-up correlation between the connecting rods and the axle rod, a cross-section of the axle rod can be non-circular entirely or partially. The axle rod 422 is rotatably disposed to the shell 2, more specifically, to the external shell 24 and the fixing plate 26, so that the two connecting rods are able to pivot around the axle rod 422. The first connecting rod 421 extends near the operation portion 41, and the second connecting rod 423 extends near the buckle plate 32. The operation portion 41 abuts against the first connecting rod 421. Thus, when the operation portion 41 moves, the first connecting rod 421 is driven to pivot around the axle rod 422 to drive the axle rod 422 to rotate, and the second connecting rod 423 also pivots. Thereby, the second connecting rod 423 alternatively abuts against the hook portion 321 to position or release the buckle plate 32.

In use, a user can inserts a plug into the insertion holes 22 and switches the operation portion 41 to the first position. Meanwhile, because the suppress mechanism 3 tends to be located at the suppress position, and the second connecting rod 423 buckles to the buckle plate 32, the buckle plate 32 is unable to slide toward the front plate 21 so that the suppress mechanism 3 is unable to be switched to the release position. Thereby, the suppress mechanism 3 buckles to the corresponding metal pin 11 so that the plug is unable to be detached freely.

Figure 6:
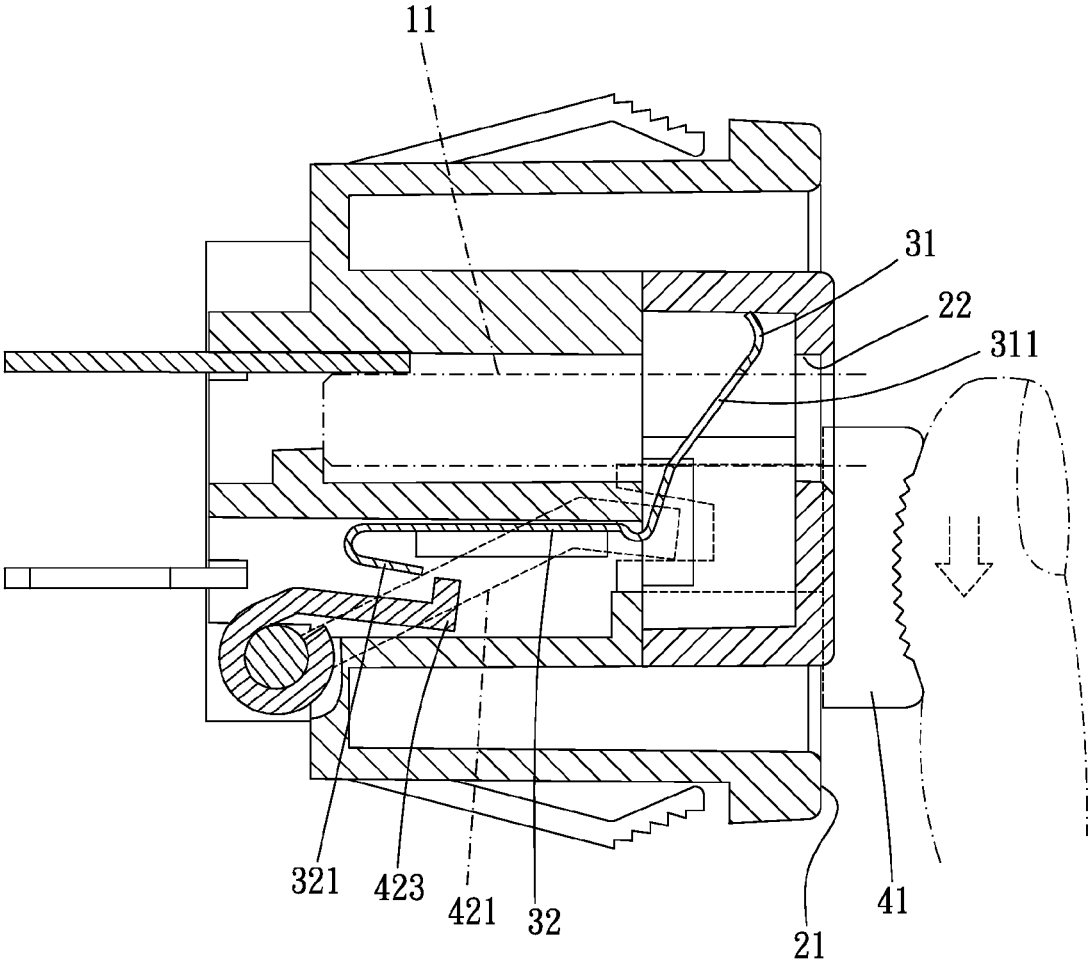
FIG. 6 is an illustration of the present invention.

Please refer to FIG. 6, when the plug is to be detached, a user can switch the operation portion 41 to the second position. At the same time, the second connecting rod 423 of the limiting portion is separated from the buckle plate 32 so that the buckle plate 32 is able to slide toward the front plate 21 freely. Thereby, the suppress mechanism 3 is able to be switched between the suppress position and the release position at will. A user only has to pull the plug slightly, the metal pin 11 may drive the suppress plate 31 and the buckle plate 32 to move so that the suppress mechanism is switched to the release position. Thereby, the insertion holes and the through holes of the suppress mechanism are available for the metal pin 11 to enter freely, and the plug can be detached.

If a user does not want the plug to be detached when the operation portion has been switched to the second position, the user can switch the operation portion 41 to the first position for, so that the limiting portion abuts against the suppress mechanism again. Thereby, the suppress mechanism is unable to be switched to the release position, and the plug is unable to be detached freely.

Thus, the safety socket can be operated by one hand. Furthermore, if a user changes his mind, the plug can be secured again by switching the operation portion.

Figure 7:
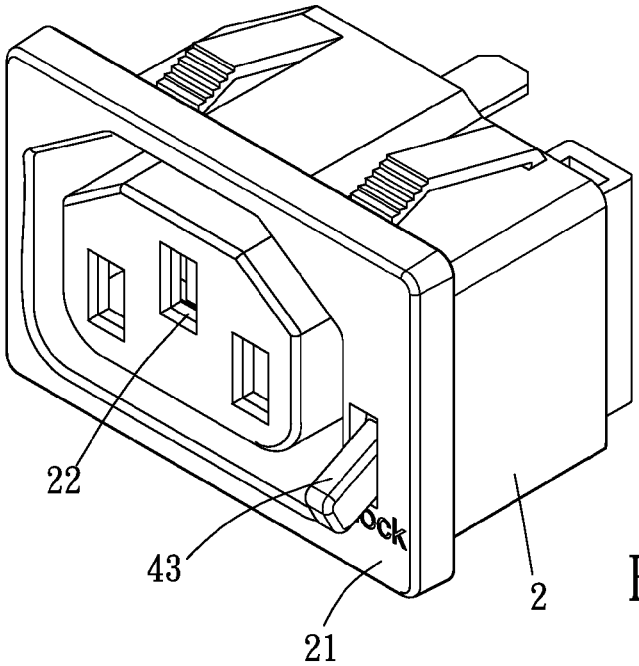
FIG. 7 is a stereogram showing a second embodiment of the present invention.
Figure 8:
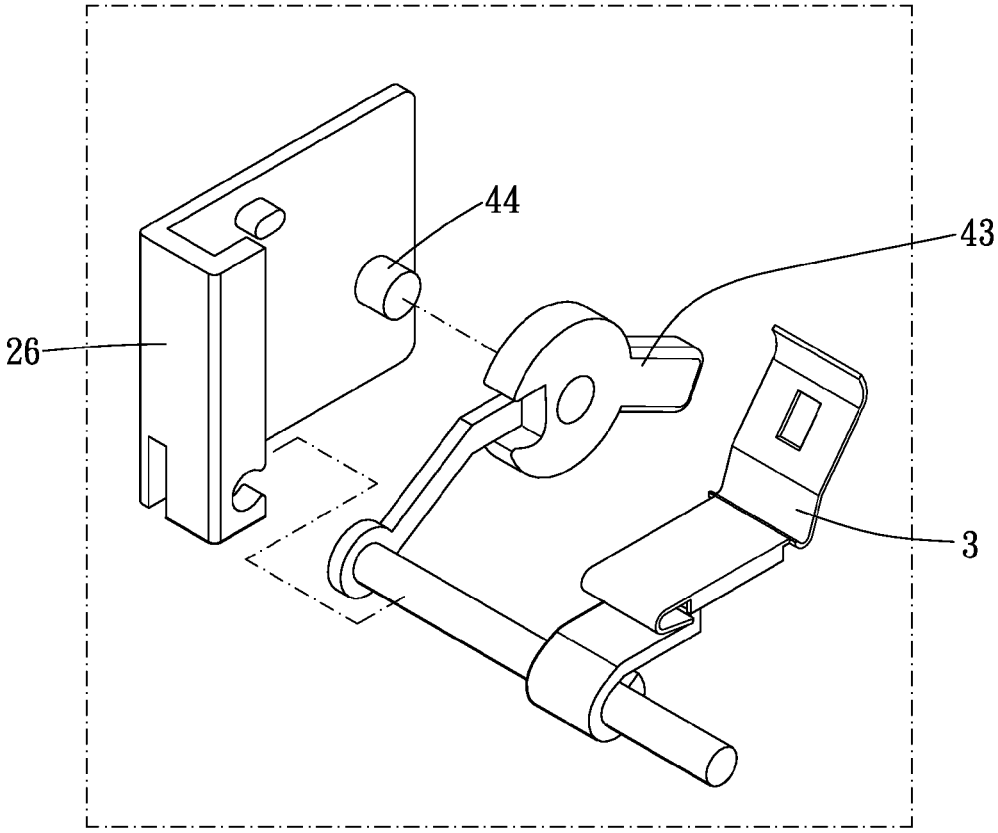
FIG. 8 is a partial stereogram showing a second embodiment of the present invention.
Figure 9:
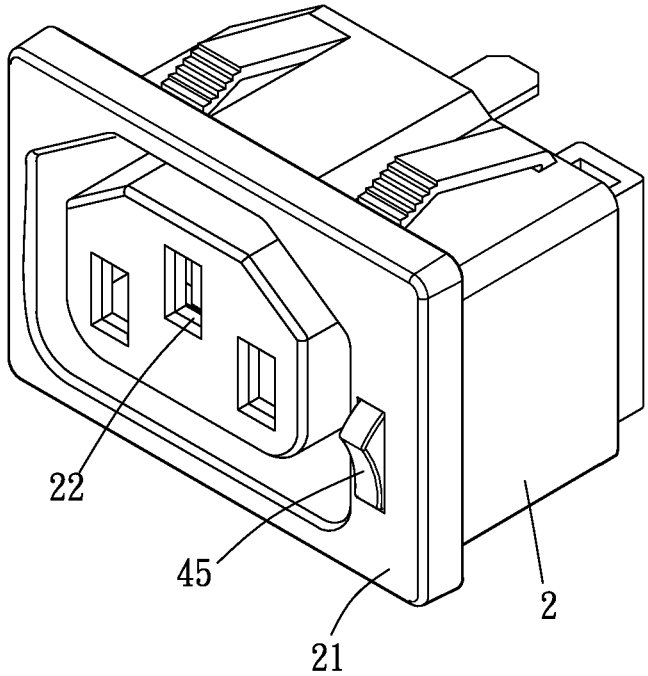
FIG. 9 is a stereogram showing a third embodiment of the present invention.

In the previous embodiment, the operation portion moves on the front plate along a straight line. Please refer to FIG. 7 and FIG. 8 for a second embodiment, the operation portion 43 rotates around a rotation axle 44 disposed inside the front plate 21 and parallely to the front plate 21. The operation portion 43 is partially exposed above the front plate 21 for toggling. Because the rotation axle 44 is located inside the front plate 21, the part of the operation portion 43 exposed above the front plate 21 moves along an arch-shaped path. Thus, the path the operation portion 43 moves along is still substantially parallel to the front plate 21. In a third embodiment, as shown in FIG. 9, the operation portion 45 further forms a protruding inclined face for a user to press and to toggle.

Figure 10:
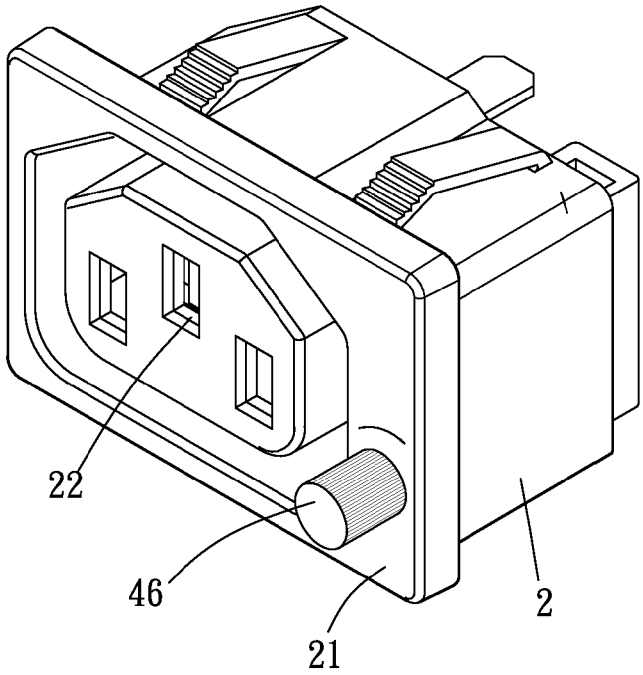
FIG. 10 is a stereogram showing a fourth embodiment of the present invention.
Figure 11:
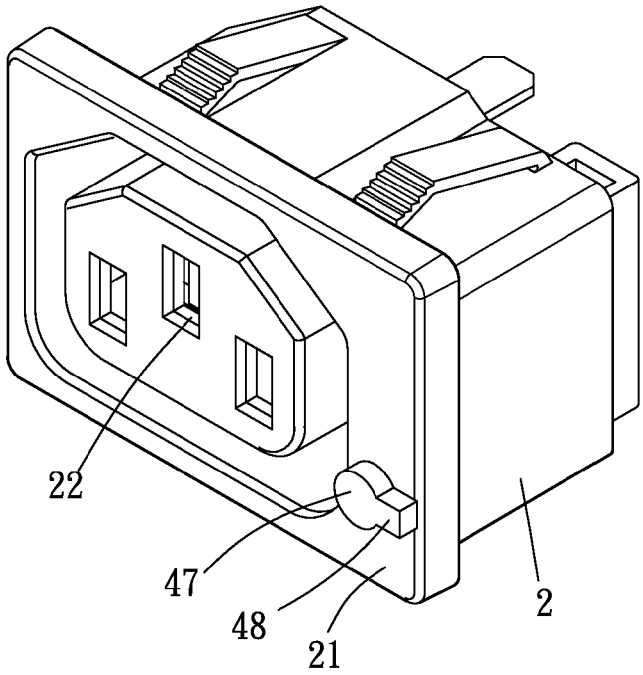
FIG. 11 is a stereogram showing a fifth embodiment of the present invention.

In other possible embodiment, the operation portion can be further modified. Please refer to FIG. 10 for a fourth embodiment, the operation portion 46 can be a rotatable knob. Even more, as shown in FIG. 11, the fifth embodiment provides a rotation axle 47 perpendicular to the front plate. Thus, the first connecting rod can be driven to pivot by the operation portions 46,48. To conclude, the operation portions 46,48 in the embodiments shown in FIG. 10 and FIG. 11 move along paths parallel to the front plate.

What is claimed is:

1. A safety socket, including:

a shell, having a front plate, the front plate forming a set of plug holes, the set of plug holes including at least two insertion holes, the insertion holes being adapted for a corresponding plug to insert therein, the plug including at least two metal pins which are able to be inserted into the insertion holes;

a suppress mechanism, disposed inside the front plate of the shell, the suppress mechanism corresponding to one of the insertion holes, the suppress mechanism being able to be switched between a release position and a suppress position, the suppress mechanism buckling to the metal pins inserted into the insertion holes when the suppress mechanism is located at the suppress position, the metal pins being able to enter or leave the insertion holes when the suppress mechanism is located at the release position;

a limitation mechanism, disposed to the shell, the limitation mechanism including an operation portion and a limiting portion, the operation portion and the limiting portion being in a linking-up correlation, the limiting portion extending near the suppress mechanism, the operation portion being located partially outside the front plate, the operation portion being able to be switched between a first position and a second position, the limiting portion being separated from the suppress mechanism when the operation portion is located at the second position so that the suppress mechanism is able to be switched between the suppress position and the release position freely;

wherein a path of the operation portion moving on the front plate is substantially parallel to the front plate.

2. The safety socket of claim 1, wherein the suppress mechanism is resilient so as to tend to located at the suppress position, when the operation portion is located at the first position, the limiting portion buckles to the suppress mechanism so that the suppress mechanism is unable to be switched to the release position.

3. The safety socket of claim 1, wherein the suppress mechanism has a suppress plate and a buckle plate, an end of the suppress plate is fixedly disposed to the shell, an opposite end of the suppress plate is connected to the buckle plate, the buckle plate is movable to change an angle between the suppress plate and the front plate so that the suppress mechanism is able to be switched between the suppress position and the release position.

4. The safety socket of claim 3, wherein the limiting portion includes a first connecting rod, an axle rod, and a second connecting rod, the first connecting rod and the second connecting rod are disposed to the axle rod and are in a linking-up correlation with the axle rod, the axle rod is rotatably disposed to the shell, the operation portion abuts against the first connecting rod, when the operation portion moves, the first connecting rod is driven to pivot around the axle rod to further drive the axle rod to rotate, thereafter the second connecting rod is driven to pivot so that the buckle plate is unable to move freely.

5. The safety socket of claim 1, wherein the operation portion is able to move between the first position and the second position along a straight line.

6. The safety socket of claim 2, wherein the operation portion is able to move between the first position and the second position along a straight line.

7. The safety socket of claim 3, wherein the operation portion is able to move between the first position and the second position along a straight line.

8. The safety socket of claim 4, wherein the operation portion is able to move between the first position and the second position along a straight line.

9. The safety socket of claim 1, wherein the operation portion is pivotable around a rotation axle, the rotation axle is disposed inside the front plate of the shell and is parallel to the front plate.

10. The safety socket of claim 2, wherein the operation portion is pivotable around a rotation axle, the rotation axle is disposed inside the front plate of the shell and is parallel to the front plate.

11. The safety socket of claim 3, wherein the operation portion is pivotable around a rotation axle, the rotation axle is disposed inside the front plate of the shell and is parallel to the front plate.

12. The safety socket of claim 4, wherein the operation portion is pivotable around a rotation axle, the rotation axle is disposed inside the front plate of the shell and is parallel to the front plate.

* * * * *